US005311844A

United States Patent [19]

Polcer

[11] Patent Number: 5,311,844

[45] Date of Patent: May 17, 1994

[54] INTERNESTED SUPERHEATER AND REHEATER TUBE ARRANGEMENT FOR HEAT RECOVERY STEAM GENERATOR

[75] Inventor: John Polcer, Morris, N.J.

[73] Assignee: Foster Wheeler Energy Corporation, Clinton, N.J.

[21] Appl. No.: 858,800

[22] Filed: Mar. 27, 1992

[51] Int. Cl.[5] ..... F62G 7/12

[52] U.S. Cl. ..... 122/470; 122/7 R; 122/466; 122/468

[58] Field of Search ..... 122/7 R, 466, 468, 470, 122/477

[56] References Cited

U.S. PATENT DOCUMENTS

| | | | |
|---|---|---|---|
| 4,418,652 | 12/1983 | Rees | 122/468 |
| 4,664,067 | 5/1987 | Haneda et al. | 122/7 R |
| 4,738,224 | 4/1988 | Bruckner et al. | 122/7 R |
| 4,944,252 | 7/1990 | Motai et al. | 122/470 |

*Primary Examiner*—Edward G. Favors
*Attorney, Agent, or Firm*—Marvin A. Naigur

[57] ABSTRACT

A heat recovery steam generator (HRSG) which contains multiple superheater and reheater tube units, each unit including an upper and lower header connected pressure-tightly together by a plurality of vertically-oriented tubes provided in alternate parallel banks, with the tubes of adjacent units being provided in an internested arrangement. Each superheater and reheater unit contains primary straight tubes and secondary bent tubes which are offset from the primary straight tubes in a direction perpendicular to the upper and lower headers and parallel to the direction of hot gas flowing transversely past the internested tubes. The ratio of the number of superheater tubes to reheater tubes in each row of tubes is provided in proportion to the desired heat transfer from the hot combustion gas to the superheated or reheated steam passing through the tubes in the generator assembly.

11 Claims, 3 Drawing Sheets

INTERNESTED SUPERHEATER AND REHEATER TUBE ARRANGEMENT FOR HEAT RECOVERY STEAM GENERATOR

BACKGROUND OF THE INVENTION

This application is related to my co-pending application Ser. No: 862,697 filed Apr. 3, 1992, now abandoned.

This invention pertains to heat recovery steam generators which contain both superheater and reheater tube units which are arranged thermally in parallel, and in which tubes for each unit are internested with each other within the steam generator.

Large high pressure utility boilers or steam generators often incorporate steam reheat cycles in which the steam which is partially spent by being expanded through a high pressure turbine, i.e. has substantial heat removed, is returned to the boiler for reheating and then is passed through a low pressure turbine. In such a manner, additional energy can be removed from each pound of steam generated, therby making the overall steam power cycle more efficient. For such heat recovery steam generators, the incorporation of a reheater unit provides some cycle efficiency advantages. The normal central station steam generator arrangement of placing the super heater in parallel with the reheater (parallel gas flow) results in minimum and thus ideal heat transfer surface area requirement. However, such parallel arrangement of superheater and reheater units causes some difficult structural problems. When reheat steam flow is not established during steam generator start-up, or when the temperature of the reheat steam does not match the parallel superheater during low power operation, then considerable temperature imbalance may occur throughout the generator and in the high pressure evaporator unit. The performance, fatigue and stress life of such a heat recovery steam generator design is suspect.

A common arrangement for overcoming these temperature imbalance problems is to alternate the superheater and reheater tube banks in the steam generator. However, considerable additional heat transfer surface is required for such a generator, because of the resulting poor temperature difference between the hot exhaust gas and the steam being heated is excessive, and can be as high as 60% additional surface. Although design refinements could reduce this additional heat transfer surface area requirement somewhat, it will always exceed the optimum area. Known heat recovery steam generators which utilize some useful tube arrangements are disclosed by U.S. Pat. No. 4,188,916 to Csathy; U.S. Pat. No. 4,664,067 to Haneda et al; U.S. Pat. No. 4,858,562 to Arakawa et al; and U.S. Pat. No. 4,944,252 to Motai et al; however further improvements are desired. The present invention provides a unique solution to this problem by providing an arrangement in which the superheat steam and reheat steam flow is alternated in each adjacent row of tubes.

SUMMARY OF INVENTION

This invention provides a heat recovery steam generator (HRSG) which contains an improved arrangement of multiple superheater and reheater tube units provided within the generator. The multiple superheater and reheater units are each aligned transversely within an elongated thermally-insulated casing, and are each suitably supported therein. Each superheater unit and reheater unit contains a plurality of tubes which are substantially vertically-oriented. The tubes for each superheater and reheater unit extend between an upper header and a lower header, to which they are connected pressure-tightly. Each unit includes primary tubes which extend straight between the upper and lower headers, and secondary tubes which are bent or offset from the primary tubes in a direction perpendicular to the headers and parallel to the direction of hot gas flow through the steam generator casing. The superheater units and reheater units are flow connected together by conduits in a desired steam flow arrangement.

The superheater and reheater tubes preferably have substantially the same tube size and spacing, and the tubes are internested with each other in adjacent units so that the superheater and reheat steam generally passes through alternate tubes in each row of tubes. For example, the units can be arranged so that the superheat steam flow can pass through all the odd numbered tubes in a row of tubes, while the reheat steam can flow through all the even numbered tubes in the same row of tubes. The ratio of the number of superheater tubes to reheater tubes in each tube row would be arranged in proportion to the desired overall heat absorption for superheating and reheating steam in the steam generator. Furthermore, because of the lower pressure and larger volume flow rate for the reheat steam, the connection of like tubes from subsequent adjacent tube rows can either be in a parallel or a series arrangement as the designer prefers for optimization of steam pressure drop inside the tubes. Adjacent rows of tubes can be connected either in parallel or in series arrangement as required to minimize overall pressure drop for the pressurized steam flowing through the tubes.

The multiple superheater and reheater tube units having internested tubes are suitably supported within the generator casing, so that a hot combustion gas can pass transversely across all the tubes so as to heat the steam passing through the tubes. To further enhance the mixing of hot exhaust gas and improve heat transfer to the steam, each double row of tubes can be staggered from the tubes in its adjacent upstream counterpart.

The invention is useful for heat recovery steam generators having at least two and up to 10 superheater units, and having at least two and up to 10 reheater units, in which the tubes have 1–3 inch outside diameter and are 20–60 ft long. The tubes are each welded pressure-tightly at each end into headers so as to form tube banks, which headers are each 4–16 inch outside diameter and 6–14 feet long depending upon the needs of a particular generator installation. The desired spacing between adjacent internested tubes in the direction of gas flow is 4–6 inches, and the desired spacing between adjacent internested tubes in the direction parallel to the headers and perpendicular to the gas flow is 4–6 inches. Exhaust gas passing transversely across the tube banks may have temperatures of 850°–1600° F., and steam pressures in the tubes may be 200–2700 psig.

The invention advantageously provides a superheater and reheater unit tube arrangement for heat recovery steam boilers or generators in which the superheater and reheater tubes are located thermally in parallel so as to minimize the heat transfer surface requirements and achieve mixing of the gas flow, while also providing good temperature balance and minimum thermal stresses developed in the tubes.

BRIEF DESCRIPTION OF DRAWINGS

The invention will be further described by reference to the following drawings, in which.

DESCRIPTION OF INVENTION

Figure 1:
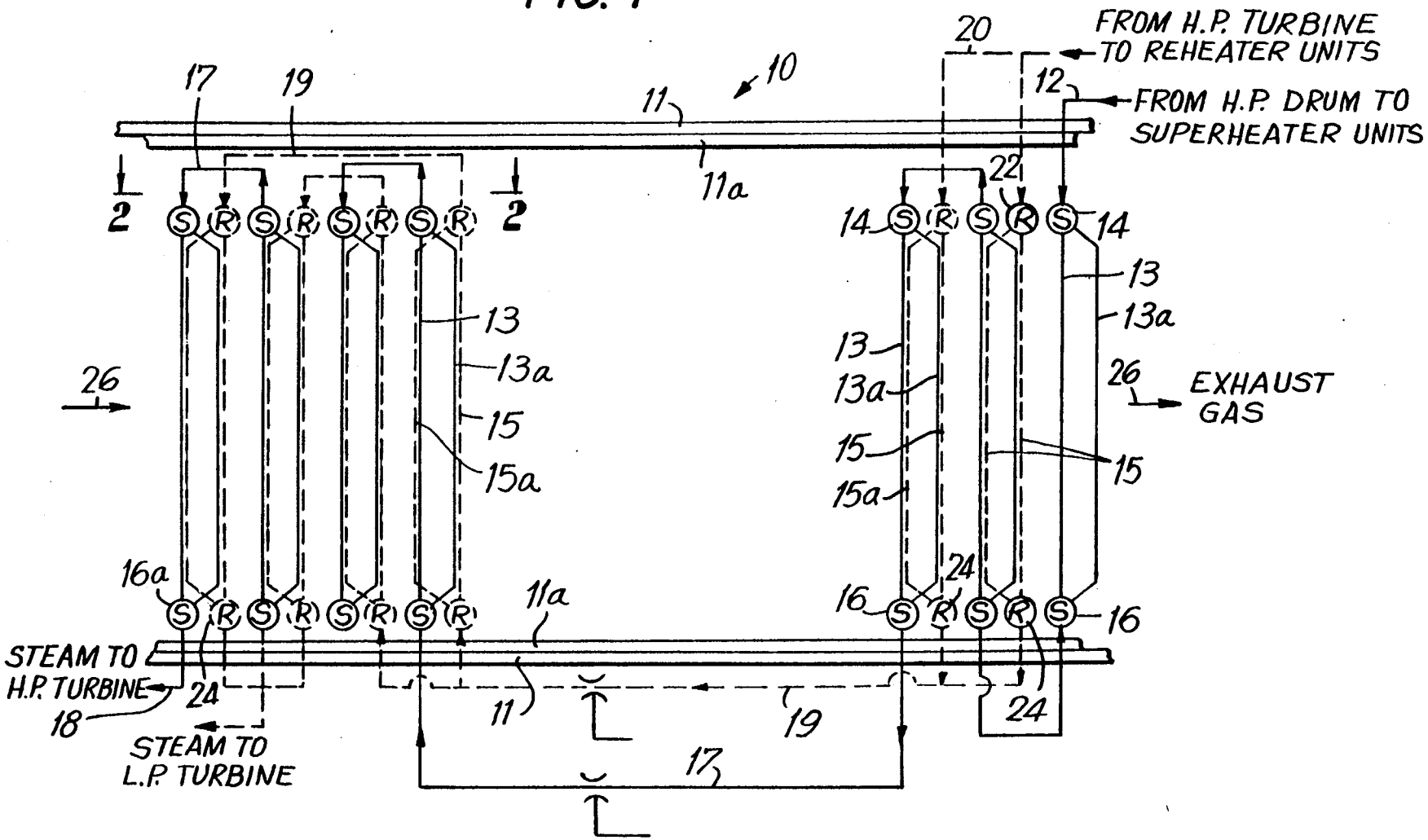
FIG. 1 shows an elevation view of a heat recovery steam generator in which vertical superheater and reheater unit tubes are internested with each other within a thermally-insulated casing according to the invention.

As is shown by FIG. 1, a heat recovery steam generator (HRSG) is provided at 10, and includes a casing 11 which is internally thermally-insulated at 11*a*. The casing 11 encloses a plurality of superheater and reheater units each containing banks of substantially vertically-oriented tubes which extend between and are connected pressure-tightly into upper and lower horizontal headers, in accordance with a particular desired steam flow arrangement. High pressure steam is supplied at 12 from an evaporator drum (not shown), and is directed to each upper header 14 of superheater units "S" for superheating the steam flowing in multiple tubes 13, which are aligned in banks or rows and are also connected pressure-tightly to a corresponding lower header 16 of each superheater "S". Each upper header 14 connected by tubes 13 to each lower header 16 forms a superheater unit "S". At least two superheater units are flow connected together by conduit 17 in a desired steam flow arrangement. The superheated steam leaves the last lower header 16*a* at 18 and flows to a high pressure turbine (not shown), in which the steam is expanded to a lower pressure to remove heat and produce shaft power.

From the high pressure turbine (not shown), low pressure steam at 20 is directed to upper headers 22 of each reheater unit "R", from which it flows through multiple tubes 15 to the corresponding lower headers 24 of the reheater unit "R". Each upper header 22 connected by the tubes 15 to lower header 24 forms a reheater unit "R". At least two reheater units are flow connected together by conduits 19. From the last lower header 24*a*, the low pressure steam is directed through a low pressure turbine (not shown) for producing additional shaft power. Each superheater unit "S" and reheater unit "R" is suitably structurally supported at either its upper or lower header within the casing 11.

The tubes of each superheater and reheater unit extend between the upper and lower headers to which they are pressure-tightly connected. Each superheater unit "S" includes a plurality of primary straight tubes 13 extending between the upper header 14 and the lower header 16, and secondary or bent tubes 13*a* which are offset from the primary straight tubes 13 in a direction perpendicular to the headers, so as to be parallel to that of the hot gas flow through casing 11. Similarly each reheater unit "R" includes both primary straight tubes 15 and secondary bent tubes 15*a* extending between the upper header 22 and lower header 24, with the bent tubes being offset from the straight tubes in a direction perpendicular to the reheater unit headers.

As is generally shown in FIG. 1, the tubes 13 and 15 are provided in alternate banks of either mainly superheater or reheater tubes, so that the superheater "S" upper headers 14 which are connected to the superheater tubes 13, 13*a*, alternate with reheater "R" upper headers 22 which are connected to the reheater tubes 15, 15*a*. Similarly, the superheater "S" lower headers 16 are alternated with reheater "R" lower headers 24. Hot combustion exhaust gas at 26, which may be derived from combustion of natural or other fuel gas or fuel oil in a gas turbine, with or without auxiliary burners, flows transversely through the casing 11 of heat recovery steam generator (HRSG) 10 to superheat the steam flowing through multiple superheater tubes 13, 13*a* and to reheat the steam flowing through the multiple reheater tubes 15, 15*a* so as to minimize the total heat transfer area required and also limit thermal stresses in the tube units. Also, the tube outside diameter and tube spacing between adjacent tubes in the superheater and reheater units are preferably all substantially identical to each other. Such tube configuration permits the superheater bent tubes 13*a* connecting the superheater headers 14 and 16 to be internested more effectively between reheater straight tubes 15 from the reheater headers 22 and 24. Similarly, the reheater bent tubes 15*a* from headers 22 and 24 are internested with the straight tubes 13 from superheater headers 14 and 16, so as to provide a tube configuration which is more compact and thermally efficient than those previously known and used.

Figure 2:
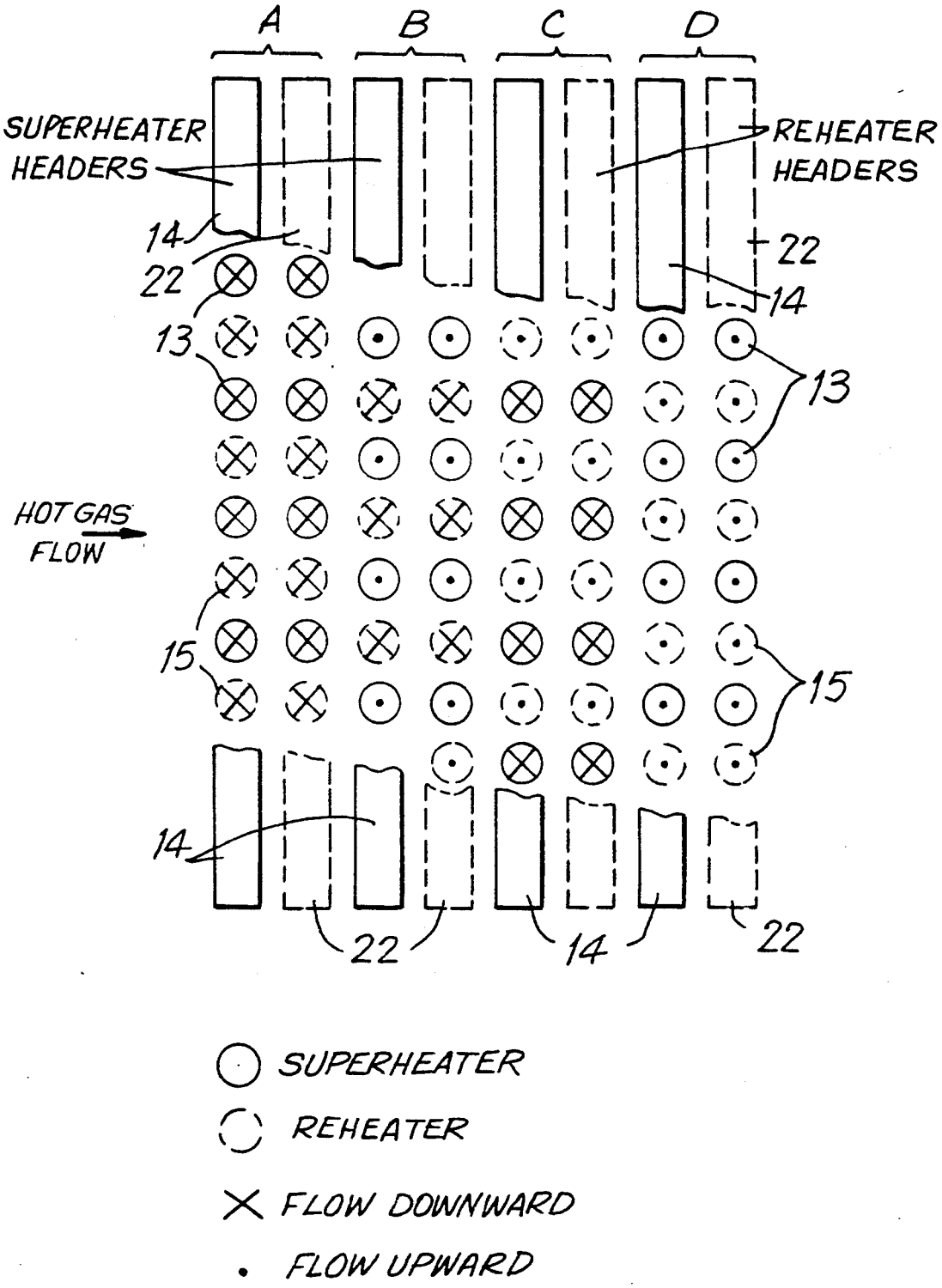
FIG. 2 shows a partial sectional view taken at line 2—2 of FIG. 1 and showing one useful pattern for flow connecting the superheat and reheat unit tubes together in a parallel and series flow arrangement.

As is additionally shown in the FIG. 2 partial sectional view, the superheater headers 14 and tubes 13 and reheater headers 22 and tubes 15 of steam generator 10 are provided in dual sets A, B, C, D, etc. with the tubes in each row containing either mainly superheater unit "S" tubes or mainly reheater unit "R" tubes. Depending upon the desired distribution of heat transfer area for the superheater tubes and the reheater tubes, some of the superheater tubes are located in the same row and internested with the reheater tubes, and vice verse. Such tube internesting configurations for the superheater and reheater tubes results in minimizing the total required heat transfer area for a heat recovery steam generator, and also limits thermal stresses in the headers and tubes during steam generator operations. By utilizing this tube arrangement, each volume of hot exhaust gas passes across each superheater tube bank and across each reheater tube bank, which is a general requirement in the industry for heat recovery steam generators.

Figure 3:
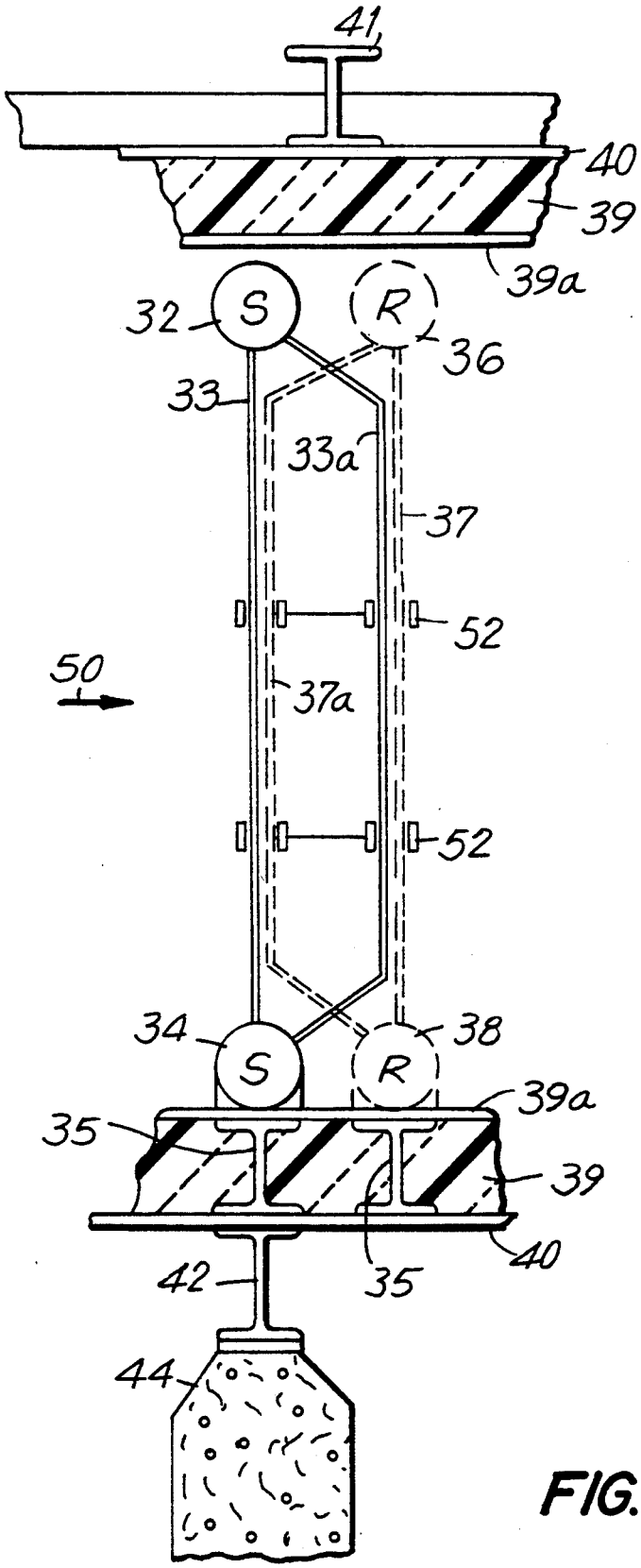
FIG. 3 shows a more detailed elevation view of a superheater and a reheater tube unit each having tubes which are internested with each other similar to FIG. 1, and are supported from their lower headers within a thermally-insulated casing.

The construction of the internested superheater units "S" and reheater tube units "R" is shown in greater detail by FIG. 3. In this preferred unit configuration, a superheater unit upper header 32 is connected pressure-tightly to a corresponding superheater lower header 34 by multiple straight tubes 33 and multiple offset tubes 33*a*. Similarly, a reheater unit upper header 36 is connected pressure-tightly to a corresponding lower header 38 by multiple straight tubes 37 and multiple offset tubes 37*a*. It is seen that the superheater offset tubes 33*a* are internested with straight reheater tubes 37, and that the reheater offset tubes 37*a* are internested with the superheater straight tubes 33 in a desired alternating arrangement, as generally shown by FIG. 2.

The superheater lower header 34 and reheater lower header 38 are each structurally supported by horizontal I-beams 35, which beams are each in turn supported from the lower side of casing 40, which usually has a rectangular cross-sectional shape. A suitable thermal insulation material 39 is provided between the lower headers 34, 38 and the casing 40 lower side, and is also provided between the upper headers 32, 36 and the casing 40 upper side. The internal thermal insulation 39 can be provided by a rigid refractory material, or preferably can be a ceramic fiber blanket material covered with a thin metal inner liner 39*a* such as stainless steel, so as to reliably retain the fiber insulation in the flowing hot gas steam 50. The casing 40 can be supported in any convenient manner, such as by steel beam structures 42 attached to reinforced concrete structures 44.

During operations of the heat recovery steam generator, a hot combustion gas at 50 flows through the elongated insulated casing 40 and transversely past the superheater tubes 33, 33*a* and the reheater tubes 37, 37*a* at superficial velocity of 30–50 ft/sec, and thereby heats the steam flowing in the tubes. For tubes having length exceeding about 10 feet, the tubes are usually stabilized against lateral vibrations by close-fitting anti-vibration support members or ties 52, which extend between superheater tubes 33 and 33*a*, and also extend between reheater tubes 37 and 37*a* and fit closely around the tubes. For tubes exceeding about 30 feet length, two ties 52 spaced about 8–10 ft. apart along the tube length should preferably be used, as shown in FIG. 3.

The tubes and headers are usually made of carbon steel or alloy steel depending upon the operating temperature and pressure required, with the tubes being metal arc welded pressure-tightly into the upper and lower headers of the superheater and reheater units.

This invention will now be further described by the following typical Example, which should not be construed as limiting in scope.

EXAMPLE

A heat recovery steam generator (HRSG) is constructed according to the invention in which multiple superheater and reheater units having banks of vertically-oriented tubes are provided within a casing, which is internally thermally insulated. The tubes are each metal arc welded pressure-tightly into an upper header and a lower header, generally as shown in FIG. 1. Hot combustion gas such as derived from combustion of natural gas, fuel gas, or oil in a gas turbine, with or without auxiliary burners, can pass transversely through the multiple tube banks. High pressure steam can be introduced into the first upper header for the superheater tubes, and superheated steam can be withdrawn from the last superheater unit lower header and expanded in a high pressure turbine for generating power. Additionally, lower pressure steam which can be bled off or extracted at an intermediate pressure from the high pressure turbine can be introduced to the first upper header for the reheater tubes, and withdrawn from the last reheater unit lower header and expanded in a low pressure turbine for generating additional power from the steam.

Some important typical characteristics and dimensions for the superheater and reheater tube units are provided in Table 1 below:

| Tube and Header Characteristics | |
|---|---|
| Tube outside diameter, in. | 2.0 |
| Tube length, ft. | 50 |
| Header outside diameter, in. | 8 |
| Header length, ft. | 10 |

-continued

| Tube and Header Characteristics | |
|---|---|
| Spacing between adjacent tubes in direction of gas flow, in. | 4.5 |
| Spacing between adjacent tubes perpendicular to gas flow direction, in. | 4.5 |
| Spacing between adjacent headers, in. | 9.0 |
| Exhaust gas temperature, °F. | 1,100 |
| Pressure in tubes, psig. | 1,500 |
| Superheater tubes steam exit temp., °F. | 1,000 |
| Reheater tubes steam exit temp., °F. | 1,000 |
| Combustion gas superficial velocity, ft/sec | 30–50 |

Although this invention has been described broadly and in terms of a preferred embodiment, it will be understood that modifications and variations can be made thereto within the scope of the invention, which is defined by the following claims.

I claim:

1. A heat recovery steam generator containing a plurality of superheater and reheater tubular units, comprising:

(a) an elongated casing through which a hot exhaust gas can flow in a general longitudinal direction;

(b) a plurality of superheater units each including an upper header which extends substantially horizontally within said casing, said upper headers being each connected pressure-tightly to a corresponding lower header by a plurality of spaced-apart superheater tubes extending therebetween, said superheater units being spaced apart from each other; and (c) a plurality of reheater units each including an upper header which extends parallel to and is located between the upper headers of said superheater units, said reheater upper headers being each connected pressure-tightly to a corresponding lower header by a plurality of spaced-apart reheater tubes extending therebetween, wherein the tubes in said superheater and reheater units are in alignment with and are internested with the reheater tubes.

2. The generator assembly of claim 1, wherein the casing is internally thermally-insulated and surrounds and supports the superheater and reheater tube units.

3. The generator assembly of claim 1, wherein the ratio of said superheater unit tubes to said reheater unit tubes provided in each row of tubes corresponds to the total superheating and reheating heat transfer surface requirement for the generator.

4. The generator assembly of claim 1, wherein the superheater and reheater tube units each have the tubes oriented substantially vertically within said casing.

5. The generator assembly of claim 1, wherein said superheater unit tubes and said reheater unit tubes each have substantially equal outside diameter and substantially equal spacing in each tube row.

6. The generator assembly of claim 1, wherein each said superheater unit and each said reheater unit contains a plurality of primary straight tubes and a plurality of secondary bent tubes which are offset from the primary straight tubes.

7. The generator assembly of claim 2, wherein said casing has a rectangular cross-sectional shape.

8. The heat recovery generator of claim 2, wherein said internal thermal insulation is a blanket of ceramic fiber material covered by a thin metal liner.

9. The generator assembly of claim 5, wherein the tube outside diameter is 1–3 inches, the header outside diameter is 4–16 inches, and the tube length is 20–60 feet.

10. The generator assembly of claim 5, wherein the spacing between adjacent internested tubes in the superheater and reheater units is 4–6 inches.

11. A heat recovery steam generator containing a plurality of superheater and reheater tubular units through which pressurized steam flows, comprising:

(a) an elongated internally thermally-insulated casing through which a hot exhaust gas can flow in a general longitudinal direction;

(b) a plurality of superheater units each including an upper header which extends substantially horizontally within said casing, said upper headers being each connected pressure-tightly to a corresponding lower header by a plurality of spaced-apart superheater tubes extending therebetween, said superheater units being spaced apart and parallel to each other; and (c) a plurality of reheater units each including an upper header which extends parallel to and is located between the upper headers of said superheater units, said reheater upper headers being each connected pressure-tightly to a corresponding lower header by a plurality of spaced-apart reheater tubes extending therebetween, wherein the tubes in said superheater and reheater units have equal outside diameters and are all equally-spaced apart and the superheater unit tubes are in alignment with and internested with the reheater unit tubes.

* * * * *